US007212182B2

(12) United States Patent
Chiang et al.

(10) Patent No.: US 7,212,182 B2
(45) Date of Patent: May 1, 2007

(54) DRIVE CIRCUIT OF TFTLCD

(75) Inventors: Tsung-Pei Chiang, Hsinchu Hsien (TW); Chun-Ta Chen, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 382 days.

(21) Appl. No.: 10/250,032

(22) Filed: May 30, 2003

(65) Prior Publication Data

US 2003/0227430 A1 Dec. 11, 2003

(30) Foreign Application Priority Data

Jun. 5, 2002 (TW) ..... 91112054 A

(51) Int. Cl.
*G09G 3/36* (2006.01)

(52) U.S. Cl. ..... 345/92; 345/87

(58) Field of Classification Search ..... 327/390, 327/536; 345/84, 87–100, 211, 80, 83, 204; 364/140, 141, 142; 365/200; 363/147
See application file for complete search history.

(56) References Cited

U.S. PATENT DOCUMENTS 5,581,455 A * 12/1996 Rossi et al. ..... 363/60
5,903,260 A * 5/1999 Imamura ..... 345/211
6,815,999 B2 * 11/2004 Brani ..... 327/536
6,898,096 B2 * 5/2005 Endo et al. ..... 363/147
6,909,413 B2 * 6/2005 Nanno et al. ..... 345/87
2001/0024139 A1 * 9/2001 Yasue ..... 327/536
2002/0057235 A1 * 5/2002 Murai et al. ..... 345/84
2002/0084831 A1 * 7/2002 Brani ..... 327/536
2002/0114199 A1 * 8/2002 Negoi ..... 365/200
2002/0126082 A1 * 9/2002 Matsuzaki ..... 345/98
2002/0167510 A1 * 11/2002 Matsumoto ..... 345/211
2003/0137481 A1 * 7/2003 Nishida ..... 345/100
2003/0142051 A1 * 7/2003 Katsutani ..... 345/87
2005/0263770 A1 * 12/2005 Sugahara et al. ..... 257/72

FOREIGN PATENT DOCUMENTS

JP 2003-216127 * 1/2002

* cited by examiner

*Primary Examiner*—Nitin Patel
(74) *Attorney, Agent, or Firm*—Jianq Chyun IP Office

(57) ABSTRACT

A drive circuit of a thin-film transistor type liquid crystal display. A plurality of source drivers is connected in series. Each of the source drives has a charge pump therein to compensate the voltage drop caused by the metal wires for connecting the neighboring source drivers. The charge pump is preferably disposed at an input of the power line. A capacitor is further connected to each of the power lines for rectifying and filtering the power source transmitted by the power lines. The drive circuit also has a plurality of gate drivers. When the voltage drop caused by the power transmission line between the gate drivers is significant enough to affect a normal operation of the gate drivers, the charge pump is installed in each of the gate drivers.

13 Claims, 2 Drawing Sheets

DRIVE CIRCUIT OF TFTLCD

CROSS REFERENCE TO RELATED APPLICATIONS

This application claims the priority benefit of Taiwan application serial no. 91112054, filed on Jun. 05, 2002.

BACKGROUND OF INVENTION

1. Field of the Invention

The invention relates in general to a drive circuit of a thin-film transistor type liquid crystal display (TFTLCD), and more particularly, to a drive circuit that maintains a sufficient voltage to provide a normal operation of such drive circuit.

2. Description of the Related Art

Recently, the conventional widely used cathode ray tube (CRT) display has been gradually replaced by the flat panel display in small volume and light weight. Currently, the most popular flat panel display includes the liquid crystal display. The application of the liquid crystal display includes the low power products such as calculator, cellular phone, palm pilot, and the notebook computer, desktop computer, and even the wall television. To obtain an optimum display area of a liquid crystal display and to form a thinnest module, the technique of applying a drive integrated circuit (drive IC) has been intensively developed and studied.

There are two commonly used technique for applying the drive IC to the liquid crystal display. One is to connect a printed circuit board mounted with a drive IC to a liquid crystal panel, the other is to install a drive IC on a liquid crystal panel directly. The latter method is also called a chip on glass method (COG).

The former method has the disadvantages including the usage of expensive wiring board (normally polyamide), requirement of large amount of devices, and the need of additional equipment to complete the connection between the drive circuit and the liquid crystal panel. Moreover, when the terminal has a minute pitch, it further restricts the tape carrier pattern and the connection to the electrodes of the liquid crystal panel.

The chip on glass method is a technique for forming a compact display. The electrodes of pixels are formed on the thin-film transistor glass of the liquid crystal panel directly. The liquid crystal panel is patterned to install the drive circuit. The drive circuit is then connected to the liquid crystal panel. This method provides an improved yield and stability and the advantages of small volume and low cost.

However, in the conventional chip on glass structure, metal wires are used to the drivers. The resistance of the metal wires causes a significant voltage drop from one driver to the other. The voltage drop seriously affects the normal operation of the drivers. Therefore, a long strip flexible printed circuit board (FPC) is provided to directly connect each source driver. Therefore, the voltage drop caused by the connection via the metal wires can be obviated. This method requires a large area of the flexible printed circuit board. In addition, as the drive circuits include data lines and power lines, a multiple layer structure is required for the flexible printed circuit board. This method does not only increase the fabrication complexity of the flexible printed circuit board, but also increase the cost and the overall volume of the liquid crystal display. Moreover, as the fabrication process is more complex, the reliability is decreased.

SUMMARY OF INVENTION

The invention provides a drive circuit, in which each source driver comprises a charge pump to compensate the voltage drop caused by the metal wire for power transmission. The large area flexible printed circuit board used in the prior art is not required, so that the increased volume of the liquid crystal display is obviated. In addition, the drive circuit provided by the invention has a simple fabrication process, such that the reliability is increased.

The drive circuit provided by the invention comprises a plurality of source drivers connected in series. The neighboring source drivers are connected with data lines and source lines. The charge pump is disposed at the inputs of the power lines, such that the voltage pump caused by the resistance of the metal wires is compensated. The power is maintained at a certain level to provide a normal operation of the drive circuit. The drive circuit further comprises a capacitor connected to each of the power lines, such that the wave of the power transmitted by the power lines can be filtered and rectified.

The drive circuit further comprises a plurality of gate drivers, preferably connected in series. When similar problem of voltage drop occur to the gate drivers, each of the gate drivers may also comprise a charge pump to resolve such problem. The capacitors for rectifying and filtering the power can be formed on the thin-film transistor glass, such that the overall volume of the liquid crystal display is not increased thereby. In addition, the source drivers and the gate drivers are connected to the liquid display panel via a flexible printed circuit board with a small area to achieve its driving function.

Both the foregoing general description and the following detailed description are exemplary and explanatory only and are not restrictive of the invention, as claimed.

DETAILED DESCRIPTION

Figure 1:
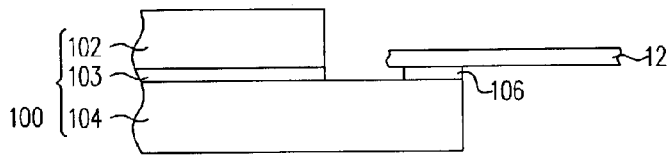
FIG. 1 shows a structure of a liquid crystal display.
Figure 2:
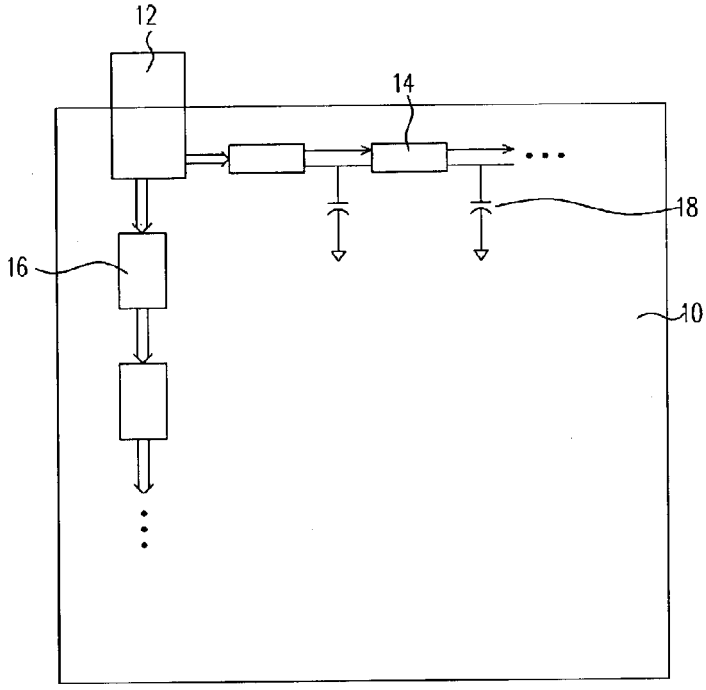
FIG. 2 shows an embodiment of a drive circuit provided by the invention.

In FIG. 1, a typical chip on glass type liquid crystal display with multiple chips is shown. The liquid crystal display comprises a liquid crystal panel 100, a drive circuit (referred as 10 as shown in FIG. 2), and a flexible printed circuit board 12 to connect the liquid crystal panel and the drive circuit. The liquid crystal panel 100 further comprises a circuit array substrate, that is, the thin-film transistor substrate 104, a counter substrate 102 and a liquid crystal material filling the space between these two substrates 102 and 104. The connection between the flexible printed circuit board 12 and the liquid crystal panel 100 is typically achieved using an electrically anisotropic conductive thin film 106, for example.

As mentioned above, in the conventional drive circuit, the power transmission between the source drivers are performed by the metal lines. Such metal lines have a resistance that generates a significant voltage drop, so that the drive circuit cannot operate properly. The prior art provides a structure to resolve such problem. That is, using a long strip flexible printed circuit board to connect each source driver directly. Therefore, the power transmission between the source drivers is achieved without using the metal wires, and consequently, the problem of voltage drop is resolved. However, this structure requires a flexible printed circuit board with a large area that increase a great amount of fabrication cost, and further increase the overall volume of the liquid crystal display. Therefore, instead of using a flexible printed circuit board with a large area, the invention applies a flexible printed circuit board connected to one source driver and one gate driver only. The power transmission is executed with the metal wires, while the voltage drop caused thereby is compensated by pumping up the power source with a charge pump installed in each source driver. Therefore, the space occupied by the flexible printed circuit board is greatly saved, and the cost is reduced. It is appreciated that people of ordinary skill in the art may modify the size and the connection between to the printed circuit board according to specific requirement. For example, the flexible printed circuit board may be connected to more than one source driver and/or more than one gate driver.

Figure 3:
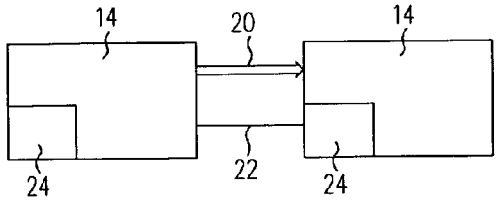
FIG. 3 shows the enlarge view of two neighboring source drivers.
Figure 4:
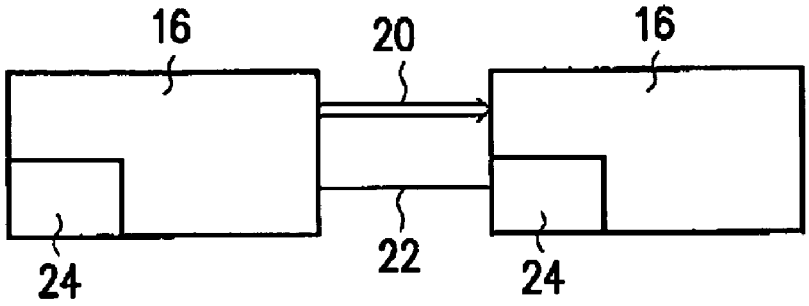
FIG. 4 shows gate drivers, each of which having a charge pump according to an embodiment of the invention.

FIG. 2 shows an embodiment of a drive circuit of a thin-film transistor type liquid crystal display provided by the invention, and FIG. 3 shows an enlarged view of two neighboring source drivers as shown in FIG. 2.

Referring to FIGS. 2 and 3, the invention provides a drive circuit 10 using a flexible printed circuit board 12 to connect the drive circuit 10 to the liquid crystal panel (100 as shown in FIG. 1). Between two neighboring source drivers 14, there are a data line and a power line for power transmission. When a power is transmitted from one source driver 14 to the next source driver 14, a voltage drop is inevitably caused by the resistance of the metal for forming the power line. This voltage drop is more and more significant for the later source drivers 14 such that the normal operation is affected. Therefore, from the second source driver 14, that is, the source driver 14 right after the one connected to the flexibility printed circuit board 12 directly, a charge pump 24 is installed therein. The charge pump 24 is preferably located at an input of the power line 22 to compensate the voltage drop. Thereby, the voltage is pumped up to a certain level to provide a normal operation of each of the source drivers 14.

In addition, the drive circuit 10 further comprises a capacitor 18 connected to each of the power lines 22 for rectifying and filtering the power transmitted thereby. The capacitors 18 are preferably formed on the thin-film transistor substrate 106 to save the space, so as to reduce the volume of the liquid crystal display.

The drive circuit 10 further comprises a plurality of gate drivers 16 connected to the flexible printed circuit board 12 in series. When similar problem of voltage drop occurs to these gate drivers 16, the charge pumps 24 may also be installed in the gate drivers 16 to compensate the voltage drop and to maintain a normal operation.

Constructed as above, that is, by installing a charge pump in each of the source drivers that are not directly connected to the flexible printed circuit board, the voltage drop caused by the resistance of the power lines can be compensated. As a result, the power of each source driver is maintained at a certain level to provide a normal operation of the drive circuit. Therefore, without a large area of the flexible printed circuit board, the liquid crystal display can be operated normally. Furthermore, additional discrete capacitors used in other conventional method are also avoided. The invention thus provides a drive circuit in small volume, low cost and with high reliability.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

The invention claimed is:

1. A liquid crystal display, comprising:
- a liquid crystal panel;
- a flexible printed circuit board; and
- a drive circuit, connected to the liquid crystal panel via the flexible printed circuit board, wherein the drive circuit further comprises:
  - a plurality of source drivers, at least one of which is connected to the flexible printed circuit board directly, wherein each of the source drivers that are not directly connected to the flexible circuit board comprises a charge pump to compensate a voltage drop caused by a plurality of power lines that transmit power between the source drivers; and
- a plurality of gate drivers, at least one of which is directly connected to the flexible printed circuit board.

2. The liquid crystal display according to claim 1, further comprising a plurality of capacitors connected to each of the power lines.

3. The liquid crystal display according to claim 2, wherein the capacitors are formed on a thin-film transistor substrate of the liquid crystal display.

4. The liquid crystal display according to claim 1, wherein each of the gate drivers further comprises a charge pump.

5. A drive circuit of a thin-film transistor type liquid crystal display, comprising at least a plurality of source drivers, wherein each source driver further comprises a charge pump to compensate a voltage drop caused by at least a power line for transmitting power between the source drivers.

6. The drive circuit according to claim 5, further comprising a capacitor connected to the power line.

7. The drive circuit according to claim 6, wherein the capacitor is formed on a thin-film transistor substrate of the liquid crystal display.

8. The drive circuit according to claim 5, further comprising a plurality of gate drivers.

9. The drive circuit according to claim 8, wherein each of the gate drivers further comprises a charge pump therein.

10. A drive circuit of a thin-film transistor type liquid crystal display, comprising:
- a flexible printed circuit board;
- a plurality of source drivers, at least one of which is connected to the flexible printed circuit board directly, wherein each of the source drivers that are not directly connected to the flexible circuit board comprises a charge pump to compensate a voltage drop caused by a plurality of power lines that transmit power between the source drivers; and
- a plurality of gate drivers, at least one of which is directly connected to the flexible printed circuit board.

11. The drive circuit according to claim 10, further comprising a plurality of capacitors connected to each of the power lines.

12. The drive circuit according to claim 11, wherein the capacitors are formed on a thin-film transistor substrate of the liquid crystal display.

13. The drive circuit according to claim 10, wherein each of the gate drivers further comprises a charge pump.

* * * * *